United States Patent [19]

Bakker et al.

[11] 3,978,302

[45] Aug. 31, 1976

[54] SWITCHING ELEMENT HAVING GOLD-COBALT CONTACTS

[75] Inventors: Martinus Antonius Maria Bakker; Gustaaf Herman Antonius van der Hoorn, both of Eindhoven, Netherlands

[73] Assignee: U.S. Philips Corporation, New York, N.Y.

[22] Filed: Sept. 12, 1974

[21] Appl. No.: 505,242

[30] Foreign Application Priority Data

Sept. 21, 1973 Netherlands ..... 7313022

[52] U.S. Cl. ..... 200/266; 29/630 C; 204/43 G

[51] Int. Cl.[2] ..... H01H 1/02

[58] Field of Search ..... 200/266, 265, 267; 29/630 C; 204/43 G, 44, 46

[56] References Cited

UNITED STATES PATENTS

| | | | |
|---|---|---|---|
| 2,905,601 | 9/1959 | Rinker et al. | 204/43 G |
| 3,668,355 | 6/1972 | Campbell et al. | 200/266 |

*Primary Examiner*—Herman T. Hohauser
*Attorney, Agent, or Firm*—Frank R. Trifari; David R. Treacy

[57] ABSTRACT

A switching element having reed contacts in a hermetically closed envelope with contact surfaces consisting of a gold alloy having a carbon content of between 0.5 and 1.5 % by weight and a cobalt content of between 1 and 6 % by weight.

3 Claims, No Drawings

SWITCHING ELEMENT HAVING GOLD-COBALT CONTACTS

BACKGROUND OF THE INVENTION

1. Field of the Invention

The invention relates to a switching element having moving contacts.

Such elements having reed contacts in a miniaturized form in a hermetically closed envelope have in late years been frequently used in modern telephone exchanges, computer systems and data transmisson systems.

In these switching elements the contact members are generally provided at the ends of resilient conductors and are enclosed in a space filled with a shield gas. The conductors consist of magnetic metal by which the contact may be opened or closed with the aid of coils or permanent magnets placed outside the envelope.

Stringent requirements as regards lifetime in an unloaded and in a loaded condition, and whether lightly or heavily loaded, are imposed on these elements, while the contact resistance must be low and constant throughout the lifetime of the element.

2. Description of the Prior Art

A coating consisting of a gold-cobalt alloy with a small quantity of carbon has been proposed as a contact surface material. This coating is electrolytically deposited from a solution of gold salt, preferably a gold cyanide complex and a cobalt salt. In such a bath an organic acid, for example, citric acid with its salt as a buffer, is also present. The combination of cobalt and cyanide provides for the low carbon content of the deposit which was found to result in very advantageous switching properties. The composition of the deposit is gold with approximately 0.3% Co and 0.5–1.5% C.

A drawback of this contact coating is, however, that the contacts equipped therewith have a tendency to sticking, resulting in a rather high percentage of rejects.

SUMMARY OF THE INVENTION

It has been found that a considerable extension of the lifetime when switching under load was achieved, and that in addition the sticking phenomenon was absent, if a contact surface coating in a switching device of the above-mentioned kind is used which consists of a gold-cobalt alloy with 1–6% Co and 0.5 – 1.5% C.

In a method according to the invention, such a contact surface coating can be obtained by electroplating in a bath comprising the following constituents in g/liter:

Au : 2.5 – 7.5 as $KAu(CN)_2$

Co : 4 – 6 as Cobalt citrate citric acid: 20 – 80 as sodium citrate ($Na_3C_6H_5O_7.2H_2O$)

pH = 3.6 – 4.5 and comprises preferably boric acid in quantity of 10 – 25 g/liter.

The boric acid has the effect that, instead of a cobalt content of approximately 0.3%, a content of 1–6% is present in the gold.

DESCRIPTION OF THE PREFERRED EMBODIMENTS

The cobalt content in the electrodeposited coating may be increased by increasing the temperature, the current density, the quantity of citrate and the quantity of boric acid. For a cobalt content of more than 6% the deposit becomes too brittle. The above-mentioned bath comprising 64 g/l citric acid at 55°C with a current density of 1.5 A/sq.dm yields a deposit with 1.2% Co, with 33 g/l citric acid, 2.3% Co. When 20 g/l boric acid is added, the Co content in the deposit will be approximately 2.4 and 4.6%, respectively. The carbon content of the deposit is between 0.5 and 1.5%.

To achieve optimum life under unloaded switching, a contact coating having a cobalt content between 1 and 4% by weight is preferred.

EXAMPLES OF TEST RESULTS

A number of reed contacts, whose parts to be sealed within the envelope were approximately 7 mm long and 0.5 mm wide, consisting of magnetic nickel-iron were electro-plated with an Au-Co-C contact surface coating with the aid of a series of baths as described above. These reed contacts were sealed in envelopes and subjected to a load test as prescribed by the General Post Office in London, namely an inductive load test with a cable under 50 Volts and a current of 100 mA. The number of switching operations was determined for which half the number of contacts were rejected due to a contact resistance of more than 150 mOhm. The following table shows this number of switching operation as a function of the cobalt content of the gold coating.

TABLE

| % by weight Co | loaded number of switching operations with 50% rejects | unloaded number of switching operations with 50% rejects |
|---|---|---|
| 5.0 | $>20 \times 10^6$ | $1.5 \times 10^6$ |
| 2.7 | $>36 \times 10^6$ | |
| 2.2 | $40.9 \times 10^6$ | $39 \times 10^6$ |
| 1.2 | $26.2 \times 10^6$ | $>3 \times 10^6$ |
| 0.82 | $3 \times 10^6$ | $>7 \times 10^6$ |
| 0.62 | $3 \times 10^6$ | $>6.7 \times 10^6$ |

For a cobalt content of 5% the number of switching operations in case of "dry" (= unloaded) switching is considerably lower than in the range of 1–4% Co, which is the reason why a cobalt content within this range is preferred.

Another test, not tabulated above, is a life test for 72 hours at a temperature of 80°and of 120°C. The contact must open within 5 m.sec. after ending the excitation. Contacts with 2.2% Co do not result in any rejects even at 120°C.

Finally there is a test under unloaded switching to determine the number of switching operations at which 50% of the number of contacts were rejected due to a contact resistance of more than 150 mOhm. The result of this test is also shown in the table above as a function of the cobalt content.

What is claimed is:

1. In a switching element having reed contacts in a hermatically closed envelope in which the contact surfaces are clad with a coating consisting of a gold-cobalt alloy having a carbon content of between 0.5 and 1.5% by weight, the improvement wherein the contact surface coating comprises a cobalt content of between 1 and 6% by weight.

2. A switching element as claimed in claim 1, wherein the gold-cobalt alloy comprises between 1 and 4% by weight of cobalt.

3. A method of electrodepositing a carbon containing Au-Co alloy as claimed in claim 1, by means of an electrolyte comprising in grams/liter the following constituents:

Au : 2.5 – 7.5 as $KAu(CN)_2$

Co : 4 – 6 as cobalt citrate $Co_3(C_6H_5O_7)_2$ citric acid: 20 – 80 as sodium citrate $Na_3C_6H_5O_7.2H_2O$ and has a pH of 3.6 – 4.5, characterized in that the electrolyte also comprises 10 to 25 g/liter of boric acid.

* * * * *